US012729409B2

(12) United States Patent
Scott et al.

(10) Patent No.: US 12,729,409 B2
(45) Date of Patent: Sep. 8, 2026

(54) TWIP STEEL SHEET HAVING AN AUSTENITIC MATRIX

(71) Applicant: ARCELORMITTAL, Luxembourg (LU)

(72) Inventors: Colin Scott, Brantford (CA); Blandine Remy, Sanry les Vigy (FR)

(73) Assignee: ArcelorMittal, Luxembourg (LU)

( * ) Notice: Subject to any disclaimer, the term of this patent is extended or adjusted under 35 U.S.C. 154(b) by 2215 days.

(21) Appl. No.: 16/302,969

(22) PCT Filed: May 19, 2017

(86) PCT No.: PCT/IB2017/000597
§ 371 (c)(1),
(2) Date: Nov. 19, 2018

(87) PCT Pub. No.: WO2017/203342
PCT Pub. Date: Nov. 30, 2017

(65) Prior Publication Data

US 2019/0292616 A1 Sep. 26, 2019

(30) Foreign Application Priority Data

May 24, 2016 (WO) ..... PCT/IB2016/000694

(51) Int. Cl.
*C22C 38/00* (2006.01)
*C21D 6/00* (2006.01)
(Continued)

(52) U.S. Cl.
CPC ..... *C21D 8/0268* (2013.01); *C21D 6/005* (2013.01); *C21D 8/0247* (2013.01);
(Continued)

(58) Field of Classification Search
None
See application file for complete search history.

(56) References Cited

U.S. PATENT DOCUMENTS 4,067,754 A 1/1978 Elias et al.
7,799,148 B2 9/2010 Scott et al.
(Continued)

FOREIGN PATENT DOCUMENTS

CN 101617059 A 12/2009
CN 101649412 A * 2/2010
(Continued)

OTHER PUBLICATIONS

Arndt, M., Duchoslav, J., Preis, K. et al. Nanoscale surface analysis on second generation advanced high strength steel after hot dip galvanizing. Anal Bioanal Chem 405, 7119-7132 (2013). https://doi.org/10.1007/s00216-013-6801-9 (Year: 2013).*
(Continued)

*Primary Examiner* — Keith Walker
*Assistant Examiner* — Catherine P Smith
(74) *Attorney, Agent, or Firm* — Davidson Kappel LLC

(57) ABSTRACT

A TWIP steel sheet is provided having an austenitic matrix including by weight: 0.1≤C≤1.2%, 13.0≤Mn<25.0%, 0.1≤Si≤3.0%, 0.1≤Cu≤5.0%, S≤0.030%, P≤0.080%, N≤0.1%, 0.1≤Al≤4.0% and 0.1≤V≤2.50% in such way that:—when the amount of Al<2.0%, the weight ratio Al/V is between 0.2 and 8 or—when the amount of Al≥2.0%, the amount of V>0.25%, and on a purely optional basis, one or more of Nb≤0.5%, B≤0.005%, Cr≤1.0%, Mo≤0.40%, Ni≤1.0%, Ti≤0.5%, and/or 0.06≤Sn≤0.2%, the remainder of the composition being made of iron and inevitable impurities resulting from elaboration.

26 Claims, 1 Drawing Sheet

(51) Int. Cl.

| | |
|---|---|
| ***C21D 8/0247*** | (2026.01) |
| ***C21D 8/0278*** | (2026.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/20*** | (2006.01) |
| ***C22C 38/22*** | (2006.01) |
| ***C22C 38/24*** | (2006.01) |
| ***C22C 38/28*** | (2006.01) |
| ***C22C 38/32*** | (2006.01) |
| ***C22C 38/34*** | (2006.01) |
| ***C22C 38/38*** | (2006.01) |
| ***C22C 38/46*** | (2006.01) |
| ***C22C 38/58*** | (2006.01) |
| ***C23C 2/02*** | (2006.01) |
| ***C23C 2/06*** | (2006.01) |
| ***C23C 2/12*** | (2006.01) |
| ***C23C 2/28*** | (2006.01) |
| ***C23C 2/40*** | (2006.01) |
| *C21D 8/02* | (2006.01) |
| *C21D 8/0221* | (2026.01) |

(52) U.S. Cl.

CPC ..... *C21D 8/0284* (2013.01); *C21D 9/46* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/20* (2013.01); *C22C 38/22* (2013.01); *C22C 38/24* (2013.01); *C22C 38/28* (2013.01); *C22C 38/32* (2013.01); *C22C 38/34* (2013.01); *C22C 38/38* (2013.01); *C22C 38/46* (2013.01); *C22C 38/58* (2013.01); *C23C 2/02* (2013.01); *C23C 2/0224* (2022.08); *C23C 2/024* (2022.08); *C23C 2/06* (2013.01); *C23C 2/12* (2013.01); *C23C 2/28* (2013.01); *C23C 2/40* (2013.01); *C21D 8/02* (2013.01); *C21D 8/0236* (2013.01); *C21D 2201/02* (2013.01); *C21D 2211/001* (2013.01); *C21D 2211/004* (2013.01)

(56) References Cited

U.S. PATENT DOCUMENTS

| | | | | |
|---|---|---|---|---|
| 9,738,958 | B2 | 8/2017 | Chin et al. | |
| 9,920,445 | B2 | 3/2018 | Campaniello et al. | |
| 10,597,760 | B2 | 3/2020 | Kobayashi et al. | |
| 2003/0145911 | A1 | 8/2003 | Hoffmann et al. | |
| 2006/0179638 | A1 | 8/2006 | Engl et al. | |
| 2006/0278309 | A1 | 12/2006 | Bouzekri et al. | |
| 2008/0083477 | A1 | 4/2008 | Drillet et al. | |
| 2009/0010793 | A1 | 1/2009 | Becker et al. | |
| 2009/0053556 | A1* | 2/2009 | Sohn | C21D 8/0273 427/433 |
| 2009/0074605 | A1 | 3/2009 | Kim et al. | |
| 2009/0202382 | A1 | 8/2009 | Kim et al. | |
| 2010/0037993 | A1 | 2/2010 | Kim et al. | |
| 2010/0258218 | A1 | 10/2010 | Hong et al. | |
| 2011/0017361 | A1 | 1/2011 | Meurer et al. | |
| 2013/0081740 | A1 | 4/2013 | Liu | |
| 2013/0118647 | A1 | 5/2013 | Berhout et al. | |
| 2013/0177780 | A1 | 7/2013 | Park et al. | |
| 2013/0209831 | A1* | 8/2013 | Becker | B32B 15/012 428/653 |
| 2013/0209833 | A1* | 8/2013 | Scott | C21D 6/005 428/659 |
| 2014/0209216 | A1 | 7/2014 | Chin et al. | |
| 2014/0251505 | A1 | 9/2014 | Blumenau et al. | |
| 2015/0152533 | A1 | 6/2015 | Bongards et al. | |
| 2015/0211088 | A1 | 7/2015 | Kim et al. | |
| 2015/0329951 | A1* | 11/2015 | Jeon | C23C 2/06 428/659 |
| 2015/0376749 | A1 | 12/2015 | Froehlich et al. | |
| 2016/0010173 | A1 | 1/2016 | Scott et al. | |
| 2016/0186285 | A1* | 6/2016 | Kim | C21D 1/18 148/603 |
| 2016/0319388 | A1 | 11/2016 | Kim et al. | |
| 2019/0010597 | A1* | 1/2019 | Kim | C22C 38/28 |

FOREIGN PATENT DOCUMENTS

| | | | | |
|---|---|---|---|---|
| CN | 101956134 | A | | 1/2011 |
| CN | 102127716 | A | | 7/2011 |
| CN | 101550515 | B | * | 5/2012 |
| CN | 102985578 | A | | 3/2013 |
| CN | 105473748 | A | | 8/2013 |
| CN | 103820735 | A | | 5/2014 |
| CN | 103993149 | A | | 8/2014 |
| EP | 1878811 | A1 | | 1/2008 |
| EP | 2208803 | A1 | | 7/2010 |
| EP | 3088548 | A1 | | 11/2016 |
| JP | 2005120399 | A | | 5/2005 |
| JP | 2006118000 | A | | 5/2006 |
| JP | 2006176843 | A | | 7/2006 |
| JP | 2011-514436 | | | 5/2011 |
| JP | 2014-505168 | | | 2/2014 |
| JP | 2014177662 | A | | 9/2014 |
| JP | 2014-529684 | | | 11/2014 |
| JP | 2009-545676 | | | 12/2014 |
| JP | 2006-509912 | | | 3/2016 |
| JP | 2016-508183 | | | 3/2016 |
| JP | 2016514208 | A | | 5/2016 |
| JP | 2016534224 | A | | 11/2016 |
| KR | 20090020278 | A | | 2/2009 |
| KR | 20090070502 | | | 7/2009 |
| KR | 20120104021 | | | 9/2012 |
| KR | 2013-0111214 | | | 10/2013 |
| KR | 20140013333 | A | | 2/2014 |
| RU | 2361931 | C2 | | 7/2009 |
| RU | 2 524 027 | | | 7/2014 |
| WO | 2009084792 | A1 | | 7/2009 |
| WO | 2009084793 | A1 | | 7/2009 |
| WO | WO2015012357 | A1 | | 1/2015 |
| WO | WO2015/077934 | | | 6/2015 |
| WO | 2015099221 | A1 | | 7/2015 |

OTHER PUBLICATIONS

N. K. Tewary , S. K. Ghosh , S. Chatterjee , Effect of Annealing on Microstructure and Mechanical Behaviour of Cold Rolled Low C, High Mn TWIP Steel, International Journal of Metallurgical Engineering, vol. 4 No. 1, 2015, pp. 12-23. doi: 10.5923/j.ijmee.20150401.03. (Year: 2015).*

J.R. Davis, Surface Engineering of Carbon and Alloy Steels, Surface Engineering, vol. 5, ASM Handbook, Edited by C.M. Cotell, J.A. Sprague, F.A. Smidt, Jr., ASM International, 1994, p. 712-713, https://doi.org/10.31399/asm.hb.v05.a0001304 (Year: 1994).*

Bakhtiari, A., M.R. Toroghinejad, and F. Ashrafizadeh. 2014. "The Effect of Zinc Bath Temperature on the Morphology, Texture and Corrosion Behaviour of Industrially Produced Hot-Dip Galvanized Coatings". Metallurgical and Materials Engineering 20 (1):41-52. (Year: 2014).*

CN 101550515 B English Machine translation (Year: 2012).*

CN 101649412 A English Machine Translation (Year: 2008).*

Townsend. "Continuous Hot Dip Coatings." ASM Handbook, vol. 5: Surface Engineering. pp. 339-348. 1994. (Year: 1994).

(56) References Cited

OTHER PUBLICATIONS

Wolfgang Bleck et al., "New Methods in Steel Design," Metec 2015, Jun. 19, 2015.

* cited by examiner

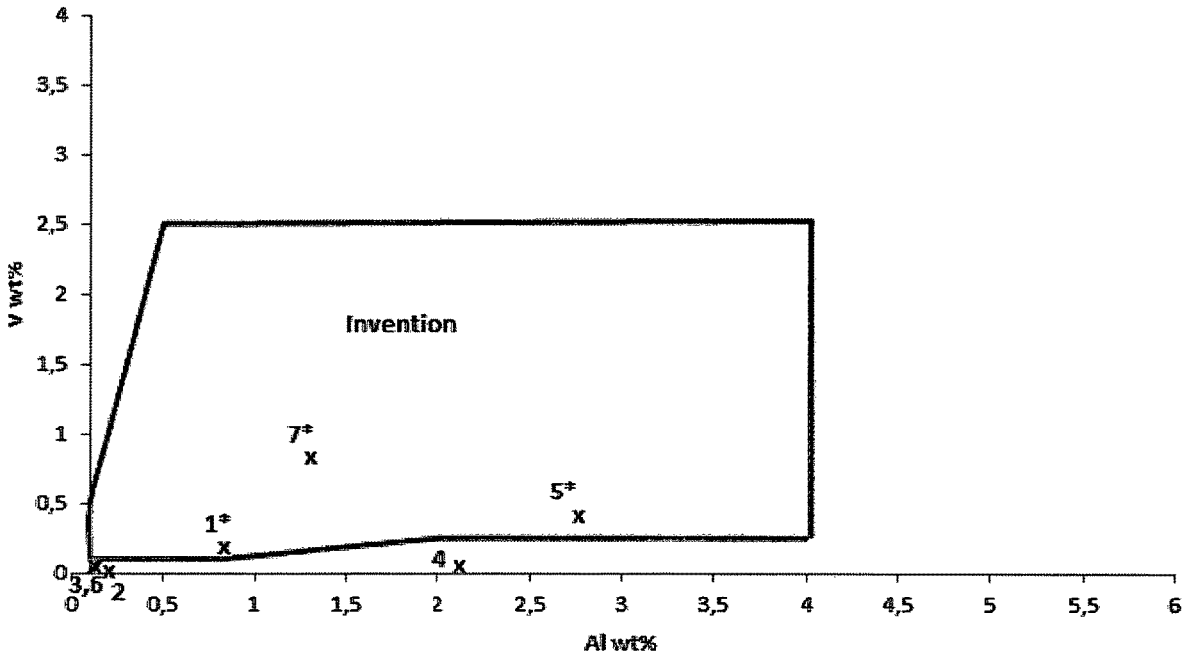
V wt%
Al wt%
Invention
7*
5*
1*
4
3,6
2
0
0,5
1
1,5
2
2,5
3
3,5
4
4,5
5
5,5
6

TWIP STEEL SHEET HAVING AN AUSTENITIC MATRIX

FIELD OF THE INVENTION

The present invention relates to a TWIP steel sheet having an austenitic matrix and a method for the manufacture of this TWIP steel. The invention is particularly well suited for the manufacture of automotive vehicles.

BACKGROUND

With a view of saving the weight of vehicles, it is known to use high strength steels for the manufacture of automobile vehicle. For example for the manufacture of structural parts, mechanical properties of such steels have to be improved. However, even if the strength of the steel is improved, the elongation and therefore the formability of high steels decreased. In order to overcome these problems, twinning induced plasticity steels (TWIP steels) having good formability have appeared. Even if these products show a very good formability, mechanical properties such as Ultimate tensile strength (UTS) and yield stress (YS) may not be high enough to fulfill automotive application.

To improve the strength of these steels while keeping good workability, it is known to induce a high density of twins by cold-rolling followed by a recovery treatment removing dislocations but keeping the twins. However, two processes are in competition, the recovery process and the recrystallization process. Indeed, it is difficult to control the recovery process since kinetics between both processes are quite closed. Consequently, there is a need to provide a way to control the recovery process in order to avoid the recrystallization.

The patent application KR20140013333 discloses a method of manufacturing a high-strength and high-manganese steel sheet with an excellent bendability and elongation, the method comprising the steps of:

- homogenization-processing, by heating to 1050-1300° C., a steel ingot or a continuous casting slab comprising, by weight %, carbon (C): 0.4~0.7%, manganese (Mn): 12~24%, aluminum (Al): 1.1~3.0%, silicon (Si): 0.3% or less, titanium (Ti): 0.005~0.10%, boron (B): 0.0005~0.0050%, phosphorus (P): 0.03% or less, sulfur (S): 0.03% or less, nitrogen(N): 0.04% or less, and the remainder being iron and other unavoidable impurities;
- hot-rolling the homogenization-processed steel ingot or the continuous casting slab at the finish hot rolling temperature of 850-1000° C.;
- coiling the hot-rolled steel sheet at 400-700° C.;
- cold-rolling the wound steel sheet;
- continuously annealing the cold-rolled steel sheet at 400-900° C.;
- optionally, coating step by hot-dip galvanization or electro-galvanization,
- re-rolling the continuously annealed steel sheet at the reduction ratio of 10~50% and
- re-heat processing the rerolled steel sheet at 300-650° C. during 20 seconds to 2 hours.

However, since the coating is deposited before the second cold-rolling, there is a huge risk that the metallic coating is mechanically damaged. Moreover, since the re-heat step is realized after the coating deposition, the interdiffusion of steel and the coating will appear resulting in a significant modification of the coating and therefore of the coating desired properties. Additionally, the re-heat step can be performed in a wide range of temperature and time and none of these elements has been more specified in the specification, even in the examples. Then, by implementing this method, there is a risk that the productivity decreases and costs increase since a lot of steps are performed to obtain the TWIP steel. Finally, the patent application KR20140013333 is completely silent on the competition between the recrystallization and the recovery and therefore, do not disclose any way to control the recovery step in order to avoid the recrystallization.

SUMMARY OF THE INVENTION

Thus, an object of an embodiment of the present invention is to solve the above drawbacks by providing a TWIP steel having a high strength, an excellent formability and elongation, such TWIP steel being recovered. It aims to make available, in particular, an easy to implement method in order to obtain this TWIP steel.

This object is achieved by providing a TWIP steel sheet according to an embodiment of the present invention having an austenitic matrix comprising by weight: $0.1 \leq C \leq 1.2\%$, $13.0 \leq Mn < 25.0\%$, $0.1 \leq Si \leq 3.0\%$, $0.1 \leq Cu \leq 5.0\%$, $S \leq 0.030\%$, $P \leq 0.080\%$, $N \leq 0.1\%$, $0.1 \leq Al \leq 4.0\%$ and $0.1 \leq V \leq 2.50\%$ in such way that:—when the amount of $Al < 2.0\%$, the weight ratio Al/V is between 0.2 and 8 or—when the amount of $Al \geq 2.0\%$, the amount of $V > 0.25\%$, and on a purely optional basis, one or more of $Nb \leq 0.5\%$, $B \leq 0.005\%$, $Cr \leq 1.0\%$, $Mo \leq 0.40\%$, $Ni \leq 1.0\%$, $Ti \leq 0.5\%$, and/or $0.06 \leq Sn \leq 0.2\%$, the remainder of the composition being made of iron and inevitable impurities resulting from elaboration.

Another object of the present invention is a method for providing a TWIP steel sheet in accordance with another embodiment of the present invention. The method comprises feeding a slab having a composition including, by weight: $0.1 \leq C \leq 1.2\%$, $13.0 \leq Mn < 25.0\%$, $0.1 \leq Si \leq 3.0\%$, $0.1 \leq Cu \leq 5.0\%$, $S \leq 0.030\%$, $P \leq 0.080\%$, $N \leq 0.1\%$, $0.1 \leq Al \leq 4.0\%$ and $0.1 \leq V \leq 2.50\%$ in such way that:—when the amount of $Al < 2.0\%$, the weight ratio Al/V is between 0.2 and 8 or—when the amount of $Al \leq 2.0\%$, the amount of $V > 0.25\%$, and on a purely optional basis, one or more of $Nb \leq 0.5\%$, $B \leq 0.005\%$, $Cr \leq 1.0\%$, $Mo \leq 0.40\%$, $Ni \leq 1.0\%$, $Ti \leq 0.5\%$, and/or $0.06 \leq Sn \leq 0.2\%$, the remainder of the composition being made of iron and inevitable impurities resulting from elaboration. The method further includes thereafter processing the slab into the TWIP steel sheet, the processing including heating at a temperature above 1000° C. and hot rolling with a final rolling temperature of at least 850° C., coiling at a temperature below or equal to 580° C., first cold-rolling with a reduction rate between 30 and 70%, recrystallization annealing between 700 and 900° C., second cold-rolling with a reduction rate between 1 to 50% and performing a recovery heat treatment.

Other characteristics and advantages of the invention will become apparent from the following detailed description of the invention.

BRIEF DESCRIPTION OF THE DRAWINGS

To illustrate the invention, various embodiments and trials of non-limiting examples will be described, particularly with reference to the following FIGURE:

FIG. 1 illustrates one embodiment according to the present invention.

DETAILED DESCRIPTION

The following terms will be defined:

UTS: ultimate tensile strength (MPa),

YS: yield strength (MPa),

UE: uniform elongation and

TE: total elongation (%).

The invention relates to a cold rolled and recovered TWIP steel sheet having an austenitic matrix comprising by weight:

$0.1<C<1.2\%$, $13.0\leq Mn<25.0\%$, $0.1\leq Si\leq 3.0\%$, $0.1\leq Cu\leq 5.0\%$, $S\leq 0.030\%$, $P\leq 0.080\%$, $N\leq 0.1\%$, $0.1\leq Al\leq 4.0\%$ and $0.1\leq V\leq 2.50\%$ in such way that:

when the amount of $Al<2.0\%$, the weight ratio Al/V is between 0.2 and 8 or when the amount of $Al\leq 2\%$, the amount of $V>0.25\%$, and on a purely optional basis, one or more elements such as $Nb\leq 0.5\%$, $B\leq 0.005\%$, $Cr\leq 1.0\%$, $Mo\leq 0.40\%$, $Ni\leq 1.0\%$, $Ti\leq 0.5\%$, $0.06\leq Sn\leq 0.2\%$, the remainder of the composition making up of iron and inevitable impurities resulting from the elaboration.

Without willing to be bound by any theory it seems that the TWIP steel sheet according to the invention allows for an improvement of the mechanical properties such as the total elongation thanks to this specific microstructure, in particular with the combination of the amount of Al with respect to V as described above. Indeed, outside the specific amount of Al with respect to V, there is a risk that the steel is not enough strengthened.

Regarding the chemical composition of the steel, C plays an important role in the formation of the microstructure and the mechanical properties. It increases the stacking fault energy and promotes stability of the austenitic phase. When combined with a Mn content ranging from 13.0 to 25.0 by weight, this stability is achieved for a carbon content of 0.1% or higher. In case there are vanadium carbides, a high Mn content may increase the solubility of vanadium carbide (VC) in austenite. However, for a C content above 1.2%, there is a risk that the ductility decreases due to for example an excessive precipitation of vanadium carbides or carbonitrides. Preferably, the carbon content is between 0.20 and 1.2%, more preferably between 0.5 and 1.0% and advantageously between 0.71 and 1.0% by weight so as to obtain sufficient strength combined optionally with optimum carbide or carbonitride precipitation.

Mn is also an essential element for increasing the strength, for increasing the stacking fault energy and for stabilizing the austenitic phase. If its content is less than 13.0%, there is a risk of martensitic phases forming, which very appreciably reduce the deformability. Moreover, when the manganese content is greater than 25.0%, formation of twins is suppressed, and accordingly, although the strength increases, the ductility at room temperature is degraded. Preferably, the manganese content is between 15.0 and 24.0 and more preferably between 17.0 and 24.0% so as to optimize the stacking fault energy and to prevent the formation of martensite under the effect of a deformation. Moreover, when the Mn content is greater than 24.0%, the mode of deformation by twinning is less favored than the mode of deformation by perfect dislocation glide.

Al is a particularly effective element for the deoxidation of steel. Like C, it increases the stacking fault energy which reduces the risk of forming deformation martensite, thereby improving ductility and delayed fracture resistance. However, Al is a drawback if it is present in excess in steels having a high Mn content, because Mn increases the solubility of nitrogen in liquid iron. If an excessively large amount of Al is present in the steel, the N, which combines with Al, precipitates in the form of aluminum nitrides (AlN) that impede the migration of grain boundaries during hot conversion and very appreciably increases the risk of cracks appearing in continuous casting. In addition, as will be explained later, a sufficient amount of N must be available in order to form fine precipitates, essentially of carbonitrides. Preferably, the Al content is below or equal to 2%. When the Al content is greater than 4.0%, there is a risk that the formation of twins is suppressed decreasing the ductility.

Vanadium also plays an important role within the context if the invention. According to the present invention, the amount of V is such that $0.1\leq V\leq 2.5\%$ and preferably $0.1\leq V\leq 1.0\%$. Preferably, V forms precipitates. Without willing to be bound by any theory, it seems that vanadium under the form of nitrides, carbides or carbonitrides precipitates increasingly delay the recrystallization so the recovery step can be performed without any risk of recrystallization. Preferably, the volumic fraction of such elements in steel is between 0.0001 and 0.05%. Preferably, vanadium elements are mostly localized in intragranular position. Advantageously, vanadium elements have a mean size below 7 nm, preferably between 0.2 and 5 nm.

In addition to the above limits for aluminium and vanadium amounts, those elements have to respect the following conditions:

if Al is strictly under 2.0%, the weight ratio Al/V has to be between 0.2 and 8 and if Al is $\leq 2.0\%$, the amount of V is strictly above 0.25%.

With these specific amounts of Al with respect to V, it is believed that Al is present in solid solution in the steel delaying the recrystallization in addition to Vanadium precipitates during the recovery step and therefore increasing the mechanical properties of the TWIP steel such as the total elongation.

The nitrogen content must be 0.1% or less so as to prevent excessive precipitation of AlN and the formation of volume defects (blisters) during solidification. In addition, when elements are capable of precipitating in the form of nitrides, such as vanadium, niobium, titanium, chromium, molybdenum and boron, the nitrogen content must not exceed 0.1%.

Silicon is also an effective element for deoxidizing steel and for solid-phase hardening. However, above a content of 3.0%, it reduces the elongation and tends to form undesirable oxides during certain assembly processes, and it must therefore be kept below this limit. Preferably, the content of silicon is below or equal to 0.6%.

Likewise, copper with a content between 0.1 and 5.0% is one means of hardening the steel by precipitation of copper metal. Moreover, it is believed that the copper acts on the delay of the recrystallization. However, above this content, copper is responsible for the appearance of surface defects in hot-rolled sheet. Preferably, the amount of copper is below 2.0%.

Sulfur and phosphorus are impurities that embrittle the grain boundaries. Their respective contents must not exceed 0.030 and 0.080% so as to maintain sufficient hot ductility.

Some Boron may be added up to 0.005%, preferably up to 0.001%. This element segregates at the grain boundaries and increases their cohesion. Without intending to be bound to a theory, it is believed that this leads to a reduction in the residual stresses after shaping by pressing, and to better resistance to corrosion under stress of the thereby shaped parts. This element segregates at the austenitic grain boundaries and increases their cohesion. Boron precipitates for example in the form of borocarbides and boronitrides.

Nickel may be used optionally for increasing the strength of the steel by solution hardening. However, it is desirable, among others for cost reasons, to limit the nickel content to a maximum content of 1.0% or less and preferably between below 0.3%.

Titanium and Niobium are also elements that may optionally be used to achieve hardening and strengthening by forming precipitates. However, when the Nb or Ti content is greater than 0.50%, there is a risk that an excessive precipitation may cause a reduction in toughness, which has to be avoided. Preferably, the amount of Ti is between 0.040% and 0.50% by weight or between 0.030% and 0.130% by weight. Preferably, the titanium content is between 0.060% and 0.40% and for example between 0.060% and 0.110% by weight. Preferably, the amount of Nb is between 0.070% and 0.50% by weight or 0.040 and 0.220%. Preferably, the niobium content is between 0.090% and 0.40% and advantageously between 0.090% and 0.20% by weight.

Chromium and Molybdenum may be used as optional element for increasing the strength of the steel by solution hardening. However, since chromium reduces the stacking fault energy, its content must not exceed 1.0% and preferably between 0.070% and 0.6%. Preferably, the chromium content is between 0.20% and 0.5%. Molybdenum may be added in an amount of 0.40% or less, preferably in an amount between 0.14% and 0.40%.

Furthermore, without willing to be bound by any theory, it seems that precipitates of Vanadium, Titanium, Niobium, Chromium and Molybdenum can reduce the sensitivity to delayed cracking, and do so without degrading the ductility and toughness properties. Thus, preferably, at least one element chosen from Titanium, Niobium, Chromium and Molybdenum under the form of carbides, nitrides and carbonitrides is present in an amount between 0.01 and 0.025%.

Optionally, tin (Sn) is added in an amount between 0.06 and 0.2% by weight. without willing to be bound by any theory, it is believed that since tin is a noble element and does not form a thin oxide film at high temperatures by itself, Sn is precipitated on a surface of a matrix in an annealing prior to a hot dip galvanizing to suppress a pro-oxidant element such as Al, Si, Mn, or the like from being diffused into the surface and forming an oxide, thereby improving galvanizability. However, when the added amount of Sn is less than 0.06%, the effect is not distinct and an increase in the added amount of Sn suppresses the formation of selective oxide, whereas when the added amount of Sn exceeds 0.2%, the added Sn causes hot shortness to deteriorate the hot workability. Therefore, the upper limit of Sn is limited to 0.2% or less.

The steel can also comprise inevitable impurities resulting from the development. For example, inevitable impurities can include without any limitation: O, H, Pb, Co, As, Ge, Ga, Zn and W. For example, the content by weight of each impurity is inferior to 0.1% by weight.

In a preferred embodiment, the TWIP steel comprising Al, V, C, Mn, Si, Cu and Nb so as to ensure that the following equation is satisfied:

$$105.1*Al\ \% - 358.1*V\ \% \leq 279.67*C\ \% - 11*Mn\ \% + 30*Si\ \% - 69.02*Cu\ \% + 78.3*Nb\ \% + 144$$

Indeed, without willing to be bound by any theory it seems that when the above equation is satisfied, the mechanical properties of the TWIP steel are further improved.

Preferably, the mean size of grain of steel is up to 5 μm, preferably between 0.5 and 3 μm.

According to the invention, the steel sheet is recovered, meaning that it is not yet recrystallized. In a preferred embodiment, the recovered fraction of the steel is above 75% and preferably above 90%. Preferably, the recovered fraction is determined with Transmission Electron Microscope (TEM) or Scanning Electron Microscopy (SEM).

In a preferred embodiment, the steel sheet is covered by a metallic coating. The metallic coating can be an aluminum-based coating or a zinc-based coating.

Preferably, the aluminium-based coated comprises less than 15% Si, less than 5.0% Fe, optionally 0.1% to 8.0% Mg and optionally 0.1% to 30.0% Zn, the remainder being Al.

Advantageously, the zinc-based coating comprises 0.01-8.0% Al, optionally 0.2-8.0% Mg, the remainder being Zn.

For example, the coated steel sheel is a galvannealed steel sheet obtained after an annealing step performed after the coating deposition.

In a preferred embodiment, the steel sheet has a thickness between 0.4 and 1 mm.

The method according to the present invention for producing a TWIP steel sheet comprises the following steps:

A. The feeding of a slab having the above mentioned composition,
B. Reheating such slab and hot rolling it,
C. A coiling step,
D. A first cold-rolling,
E. A recrystallization annealing,
F. The second cold-rolling and
G. A recovery heat treatment.

According to the present invention, the method comprises the feeding step A) of a semi product, such as slabs, thin slabs, or strip made of steel having the composition described above, such slab is cast. Preferably, the cast input stock is heated to a temperature above 1000° C., more preferably above 1050° C. and advantageously between 1100 and 1300° C. or used directly at such a temperature after casting, without intermediate cooling.

The hot-rolling is then performed at a temperature preferably above 890° C., or more preferably above 1000° C. to obtain for example a hot-rolled strip usually having a thickness of 2 to 5 mm, or even 1 to 5 mm. To avoid any cracking problem through lack of ductility, the end-of-rolling temperature is preferably above or equal to 850° C.

After the hot-rolling, the strip has to be coiled at a temperature such that no significant precipitation of carbides (essentially cementite $(Fe,Mn)_3C$)) occurs, something which would result in a reduction in certain mechanical properties. The coiling step C) is realized at a temperature below or equal to 580° C., preferably below or equal to 400° C.

A subsequent cold-rolling operation followed by a recrystallization annealing is carried out. These additional steps result in a grain size smaller than that obtained on a hot-rolled strip and therefore results in higher strength properties. Of course, it must be carried out if it is desired to obtain products of smaller thickness, ranging for example from 0.2 mm to a few mm in thickness and preferably from 0.4 to 4 mm. A hot-rolled product obtained by the process described above is cold-rolled after a possible prior pickling operation has been performed in the usual manner.

The first cold-rolling step D) is performed with a reduction rate between 30 and 70%, preferably between 40 and 60%.

After this rolling step, the grains are highly work-hardened and it is necessary to carry out a recrystallization annealing operation. This treatment has the effect of restoring the ductility and simultaneously reducing the strength. Preferably, this annealing is carried out continuously. Advantageously, the recrystallization annealing E) is realized between 700 and 900° C., preferably between 750 and 850° C., for example during 10 to 500 seconds, preferably between 60 and 180 seconds. Preferably, during this annealing, at least one vanadium element under the form of nitrides, carbides or carbonitrides can precipitate delaying thus the recrystallization.

Then, a second cold-rolling step F) is realized with a reduction rate between 1 to 50%, preferably between 10 and 40% and more preferably between 20 and 40%. It allows for the reduction of the steel thickness. Moreover, the steel sheet manufactured according to the aforesaid method, may have increased strength through strain hardening by undergoing a re-rolling step. Additionally, this step induces a high density of twins improving thus the mechanical properties of the steel sheet.

After the second cold-rolling, a recovery step G) is realized in order to additionally secure high elongation and bendability of the re-rolled steel sheet. Recovery is characterized by the removal or rearrangement of dislocations in the steel microstructure while keeping the deformation twins. Both deformation twins and dislocations are introduced by plastic deformation of the material, such as rolling step.

In a preferred embodiment, a recovery step G) is performed by heating the steel sheet at a temperature between 410 and 700° C. in a batch annealing or a continuous annealing furnace. In this case, it can be followed by a hot-dip coating step G), i.e. by preparing the surface of the steel sheet for the coating deposition in a continuous annealing followed by the dipping the steel sheet in a molten metallic bath having a temperature between 410 and 700° C. depending on the nature of the molten bath.

In another preferred embodiment, the recovery step G) is performed by hot-dip coating. In this case, the recovery step and the hot-dip coating are realized in the same time allowing cost saving and the increase of the productivity in contrary to the patent application KR201413333 wherein the hot-dip plating is realized after the recrystallization annealing.

In this embodiment, it seems that the recovery process in the steel microstructure begins during the preparation of steel surface in a continuous annealing and is achieved during the dipping into a molten bath.

The preparation of the steel surface is preferably performed by heating the steel sheet from ambient temperature to the temperature of molten bath, i.e. between 410 to 700° C. In preferred embodiments, the thermal cycle can comprise at least one heating step wherein the steel is heated at a temperature above the temperature of the molten bath. For example, the preparation of the steel sheet surface can be performed at 650° C. during few seconds followed by the dipping into a zinc bath during 5 seconds, the bath temperature being at a temperature of 450° C.

Preferably, the temperature of the molten bath is between 410 and 700° C. depending on the nature of the molten bath.

Advantageously, the steel sheet is dipped into an aluminum-based bath or a zinc-based bath. Preferably, the dipping into a molten bath is performed during 1 to 60 seconds, more preferably between 1 and 20 seconds and advantageously, between 1 to 10 seconds.

In a preferred embodiment, the aluminum-based bath comprises less than 15% Si, less than 5.0% Fe, optionally 0.1 to 8.0% Mg and optionally 0.1 to 30.0% Zn, the remainder being Al. Preferably, the temperature of this bath is between 550 and 700° C., preferably between 600 and 680° C.

In another preferred embodiment, the zinc-based bath comprises 0.01-8.0% Al, optionally 0.2-8.0% Mg, the remainder being Zn. Preferably, the temperature of this bath is between 410 and 550° C., preferably between 410 and 460° C.

The molten bath can also comprise unavoidable impurities and residuals elements from feeding ingots or from the passage of the steel sheet in the molten bath. For example, the optionally impurities are chosen from Sr, Sb, Pb, Ti, Ca, Mn, Sn, La, Ce, Cr, Zr or Bi, the content by weight of each additional element being inferior to 0.3% by weight. The residual elements from feeding ingots or from the passage of the steel sheet in the molten bath can be iron with a content up to 5.0%, preferably 3.0%, by weight.

Advantageously, the recovery step G) is performed during 1 second to 30 minutes, preferably between 30 seconds and 10 minutes.

For example, an annealing step can be performed after the coating deposition in order to obtain a galvannealed steel sheet.

A TWIP steel sheet comprising an austenitic matrix having a high strength, an excellent formability and elongation is thus obtainable from the method according to the invention.

With the method according to the present invention, such TWIP steel sheet is achieved by inducing a high number of twins thanks to the two cold-rolling steps followed by a recovery step during which dislocations are removed but twins are kept.

EXAMPLE

In this example, TWIP steel sheets having the following weight composition were used:

| Samples | C % | Si % | Mn % | P % | Cr % | Cu % | Ti % | % N | S % | % Al | % V | Al/V |
|---|---|---|---|---|---|---|---|---|---|---|---|---|
| 1* | 0.595 | 0.2 | 18.3 | 0.034 | — | 1.68 | — | 0.01 | ≤0.03 | 0.785 | 0.18 | 4.36 |
| 2 | 0.635 | — | 21.79 | ≤0.08 | — | — | — | <0.001 | ≤0.03 | — | 0.16 | — |
| 3 | 0.894 | 0.513 | 18.64 | 0.02 | 0.109 | 0.156 | — | 0.0032 | ≤0.03 | 0.003 | 0.002 | 1.5 |
| 4 | 0.88 | 0.508 | 17.96 | 0.03 | 0.109 | 0.15 | — | 0.0044 | ≤0.03 | 2.11 | 0.093 | — |
| 5* | 0.876 | 0.502 | 17.63 | 0.032 | 0.108 | 0.149 | — | 0.0061 | ≤0.03 | 2.78 | 0.384 | — |
| 6 | 0.579 | 0.208 | 22.87 | 0.02 | 0.114 | 0.162 | 0.005 | 0.0037 | ≤0.03 | 0.002 | 0.007 | 0.28 |
| 7* | 0.856 | 0.21 | 21.94 | 0.027 | 0.114 | 0.155 | 0.04 | 0.008 | ≤0.03 | 1.35 | 0.891 | 1.52 |

*examples according to the present invention.

Firstly, samples were heated and hot-rolled at a temperature of 1200° C. The finishing temperature of hot-rolling was set to 890° C. and the coiling was performed at 400° C. after the hot-rolling. Then, a $1^{st}$ cold-rolling was realized with a cold-rolling reduction ratio of 50%. Thereafter, a recrystallization annealing was performed at 750° C. during 180 seconds. Afterwards, the $2^{nd}$ cold-rolling was realized with a cold-rolling reduction ratio of 30%.

Finally, for sample 1, a recovery heat step was performed during 40 seconds in total. The steel sheet was first prepared through heating in a furnace up to 675° C., the time spent between 400 and 675° C. being 37 seconds and then dipped into a molten bath comprising 9% by weight of Silicon, up to 3% of iron, the rest being aluminum, during 3 seconds. The molten bath temperature was of 675° C.

For sample 2, a recovery heat treatment was performed during 40 seconds in total. The steel sheet was first prepared through heating in a furnace up to 675° C., the time spent between 400 and 675° C. being 34 seconds and then dipped into a molten bath comprising 9% by weight of Silicon, up to 3% of iron, the rest being aluminum during 6 seconds. The molten bath temperature was of 675° C.

For samples 3 to 5, a recovery heat treatment was performed during 90 seconds in total. The steel sheet was first prepared through heating in a furnace up to 650° C., the time spent between 460 and 650° C. being 84 seconds and then dipped into a zinc bath during respectively 6 s seconds. The molten bath temperature was of 460° C.

For samples 6 and 7, a recovery heat treatment was performed during 30 seconds in total. The steel sheet was first prepared through heating in a furnace up to 625° C., the time spent between 460 and 625° C. being 24 seconds and then dipped into a zinc bath during respectively 6 s seconds. The molten bath temperature was of 460° C. Microstructures of samples 1 to 7 were analyzed with a SEM to confirm that no recrystallization did occur during the recovery step. The mechanical properties were determined. Results are in the following Table:

| Samples | Recovery time (s) | Recovered samples | YS (MPa) | UTS (MPa) | UE (%) | TE (%) | Hardness (HV) |
|---|---|---|---|---|---|---|---|
| 1* | 40 | Yes | — | 1181 | — | — | 378 |
| 2 | 40 | No | — | 1149 | — | — | 367 |
| 3 | 60 | No | 729 | 1338 | 39.25 | 42.55 | ND |
| 4 | 60 | No | 1175.5 | 1410 | 21.55 | 25.95 | ND |
| 5* | 60 | Yes | 1326 | 1472 | 13.65 | 17 | ND |
| 6 | 30 | No | 1101 | 1418.5 | 21.5 | 27.95 | ND |
| 7* | 30 | Yes | 1480 | 1653.5 | 9.35 | 11.1 | ND |

*examples according to the present invention;
ND: not done

Results show that sample 1 having the weight ratio Al/V according to the present invention was recovered. On the contrary, Trial 2 was recrystallized.

The mechanical properties of Sample 1 are better than the mechanical properties of Sample 2.

Sample 5 according to the present invention was recovered after the recovery heat treatment. On the contrary, Samples 3 and 4 were recrystallized. In addition, the mechanical properties, in particular UTS and YS, of sample 5 was higher than the mechanical properties of Samples 3 and 4.

Sample 7 according to the present invention was recovered after the recovery heat treatment. On the contrary, Sample 6 was recrystallized. In addition, the mechanical properties, in particular UTS and YS, of sample 7 were higher than the mechanical properties of Sample 6.

FIG. 1 shows the amount of Al and V in the Samples 1 to 7.

What is claimed is:

1. A cold rolled and recovered TWIP steel sheet having an austenitic matrix comprising by weight:

$0.1 \leq C \leq 1.2\%$,
$13.0 \leq Mn < 25.0\%$,
$0.1 \leq Si \leq 3.0\%$,
$0.1 \leq Cu \leq 5.0\%$,
$S \leq 0.030\%$,
$P \leq 0.080\%$,
$N \leq 0.1\%$,
$0.1 \leq Al \leq 4.0\%$ and
$0.1 \leq V \leq 2.50\%$ in such way that:
when the amount of $Al < 2.0\%$, the weight ratio Al/V is between 0.2 and 8 or
when the amount of $Al \geq 2.0\%$, the amount of $V > 0.25\%$,
and optionally one or more of the following elements:
$Nb \leq 0.5\%$,
$B \leq 0.005\%$,
$Cr \leq 1.0\%$,
$Mo \leq 0.40\%$,
$Ni \leq 1.0\%$,
$Ti \leq 0.5\%$, and
$0.06 \leq Sn \leq 0.2\%$;
the remainder of the composition being made of iron and inevitable impurities resulting from elaboration, the steel sheet having a microstructure with a recovered fraction greater than a recrystallized fraction.

2. The steel sheet according to claim 1, wherein the austenitic matrix further comprises one or more of $Nb \leq 0.5\%$,
$B \leq 0.005\%$,
$Cr \leq 1.0\%$,
$Mo \leq 0.40\%$,
$Ni \leq 1.0\%$,
$Ti \leq 0.5\%$, and
$0.06 \leq Sn \leq 0.2\%$.

3. The steel sheet according to claim 1, wherein the amount of V is between 0.1 and 1.0% by weight.

4. The steel sheet according to claim 1, wherein the amount of Al is below or equal to 2.0% by weight.

5. The steel sheet according to claim 1, wherein at least one vanadium element under the form of nitrides, carbides or carbonitrides is present in the steel sheet.

6. The steel sheet according to claim 1, wherein the amount of Cu is below 2.0% by weight.

7. The steel sheet according to claim 1, wherein the amount of Nb is between 0.070 and 0.50% by weight.

8. The steel sheet according to claim 1, wherein the amount of Si is below or equal to 0.6% by weight.

9. The steel sheet according to claim 1, wherein the amount of Al, V, C, Mn, Si, Cu and Nb by weight satisfies the following equation:

$$105.1*Al\,\% - 358.1*V\,\% \leq 279.67*C\,\% - 11*Mn\,\% + 30*Si\,\% - 69.02*Cu\,\% + 78.3*Nb\,\% + 144.$$

10. The steel sheet according to claim 1, wherein the steel sheet is covered by an aluminum-based coating.

11. The steel sheet according to claim 1, wherein the steel sheet is covered by a zinc-based coating.

12. The steel sheet according to claim 10, wherein the aluminium-based coating comprises less than 15% Si, less than 5.0% Fe, optionally 0.1 to 8.0% Mg and optionally 0.1 to 30.0% Zn, and the remainder being Al.

13. The steel sheet according to claim 11, wherein the zinc-based coating comprises 0.01-8.0% Al, optionally 0.2-8.0% Mg, and the remainder being Zn.

14. The steel sheet according to claim 1, wherein the composition includes Sn by weight in an amount $0.06 \leq Sn \leq 0.2\%$.

15. The steel sheet according to claim 1, further comprising a coating, the coating being a hot-dip metallic coating.

16. The steel sheet according to claim 1, wherein the recovered fraction is above 75%.

17. The steel sheet according to claim 1, wherein the recovered fraction is above 90%.

18. The method according to claim 15, preparing a surface of the steel sheet for coating deposition in a continuous annealing followed by the dipping the steel sheet in a molten metallic bath having a temperature between 410 and 700 °C.

19. The method according to claim 18, wherein during the preparation of surface, the steel sheet is heated from ambient temperature to the temperature of the molten bath.

20. The method according to claim 18, wherein the bath is aluminum-based and comprises less than 15% Si, less than 5.0% Fe, optionally 0.1 to 8.0% Mg and optionally 0.1 to 30.0% Zn, the remainder being Al.

21. The method according to claim 18, wherein the bath is zinc-based and comprises 0.01-8.0% A1, optionally 0.2-8.0% Mg, the remainder being Zn.

22. The method according to claims 15, wherein the recovery heat treatment is performed during 1 second to 30 minutes.

23. The method according to claim 22, wherein the recovery heat treatment is performed during 30 seconds to 10 minutes.

24. The steel sheet according to claim 1, further comprising a coating, the coating being a hot-dip metallic coating.

25. The steel sheet according to claim 1, wherein the recovered fraction is above 75%.

26. The steel sheet according to claim 1, wherein the recovered fraction is above 90%.

* * * * *